US008902266B2

(12) United States Patent
Aoi

(10) Patent No.: US 8,902,266 B2
(45) Date of Patent: Dec. 2, 2014

(54) IMAGE FORMING APPARATUS HAVING DETECTOR CONFIGURED TO DETECT INFORMATION REGARDING CARTRIDGE ATTACHED THERETO

(71) Applicant: Yosuke Aoi, Nagoya (JP)

(72) Inventor: Yosuke Aoi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/030,267

(22) Filed: Sep. 18, 2013

(65) Prior Publication Data

US 2014/0092197 A1 Apr. 3, 2014

(30) Foreign Application Priority Data

Sep. 28, 2012 (JP) ..... 2012-216231

(51) Int. Cl.

| | |
|---|---|
| ***B41J 2/435*** | (2006.01) |
| ***G03G 21/16*** | (2006.01) |
| ***B41J 29/02*** | (2006.01) |
| ***G03G 21/18*** | (2006.01) |

(52) U.S. Cl.

CPC *B41J 29/02* (2013.01); *B41J 2/435* (2013.01); *G03G 21/1652* (2013.01); *G03G 21/1871* (2013.01)

USPC ..... 347/228; 399/111

(58) Field of Classification Search

CPC ..... G03G 21/1867; G03G 21/1871; G03G 21/1875; G03G 21/1892; G03G 21/1896; G03G 2221/1892; G03G 2221/166

USPC ..... 347/124, 140, 151, 152, 158, 228, 240, 347/242, 251, 257, 263; 399/12, 25, 90, 399/110, 111, 114, 119

See application file for complete search history.

(56) References Cited

U.S. PATENT DOCUMENTS

| | | | | |
|---|---|---|---|---|
| 6,104,889 | A | 8/2000 | Saitoh | |
| 7,978,997 | B2 * | 7/2011 | Tokuda | 399/90 |
| 2001/0014225 | A1 * | 8/2001 | Otsubo et al. | 399/24 |

FOREIGN PATENT DOCUMENTS

| | | | |
|---|---|---|---|
| JP | H11-288191 | A | 10/1999 |
| JP | 2009-026539 | A | 2/2009 |

* cited by examiner

*Primary Examiner* — Hai C Pham

(74) *Attorney, Agent, or Firm* — Banner & Witcoff, Ltd.

(57) ABSTRACT

An image forming apparatus is provided, which includes a displacement member disposed at a cartridge and configured to move from a position where the displacement member receives a driving force from an apparatus main body to a position where the displacement member does not receive the driving force. The apparatus also includes a movable member disposed at the apparatus main body, the movable member moving in response to movement of the displacement member, so as to move a first electrode between a position where the first electrode contacts a second electrode and a position where the first electrode is spaced apart from the second electrode. Also, the apparatus includes a detector detecting information about the cartridge attached to the apparatus main body based on a conduction state between the first electrode and the second electrode.

18 Claims, 10 Drawing Sheets

1st STATE

2nd STATE

3rd STATE

IMAGE FORMING APPARATUS HAVING DETECTOR CONFIGURED TO DETECT INFORMATION REGARDING CARTRIDGE ATTACHED THERETO

CROSS-REFERENCE TO RELATED APPLICATION

This application claims priority under 35 U.S.C. §119 from Japanese Patent Application No. 2012-216231 filed on Sep. 28, 2012. The entire subject matter of the application is incorporated herein by reference.

BACKGROUND

1. Technical Field

The following description relates to one or more techniques for an image forming apparatus configured to electrophotographically form an image on a sheet.

2. Related Art

An image forming apparatus has been known that is configured to detect whether a cartridge attached thereto is new or not using an optical sensor.

SUMMARY

Aspects of the present invention are advantageous to provide one or more improved techniques to achieve an image forming apparatus configured to detect whether a cartridge attached thereto is new or not without using an optical sensor.

According to aspects of the present invention, an image forming apparatus configured to electro-photographically form an image on a sheet is provided, the image forming apparatus including an apparatus main body, a cartridge configured to be detachably attached to the apparatus main body, the cartridge including an electrical component, a conductive section electrically connected with the electrical component, and a movable element configured to move in response to receipt of a driving farce from the apparatus main body, a power feeder disposed at the apparatus main body and configured to contact the conductive section and apply a voltage to the electrical component, a first electrode disposed at the apparatus main body and electrically connected with the power feeder, a second electrode disposed at the apparatus main body and configured to be in contact with and spaced apart from the first electrode, a displacement member disposed at the cartridge and configured to move from a position where the displacement member is allowed to receive the driving force from the apparatus main body to a different position where the displacement member is not allowed to receive the driving force from the apparatus main body, a movable member disposed at the apparatus main body; the movable member being configured to move in response to movement of the displacement member, so as to move the first electrode between a contact position where the first electrode contacts the second electrode and a non-contact position where the first electrode is spaced apart from the second electrode, and a detector configured to detect information about the cartridge attached to the apparatus main body based on a conduction state between the first electrode and the second electrode.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described in detail with reference to the accompanying drawings. The embodiment will provide an example in which aspects of the present invention are applied to an image faulting apparatus configured to electrophotographically perform color printing.

1. Overall Configuration of Image Forming Apparatus

Figure 1:
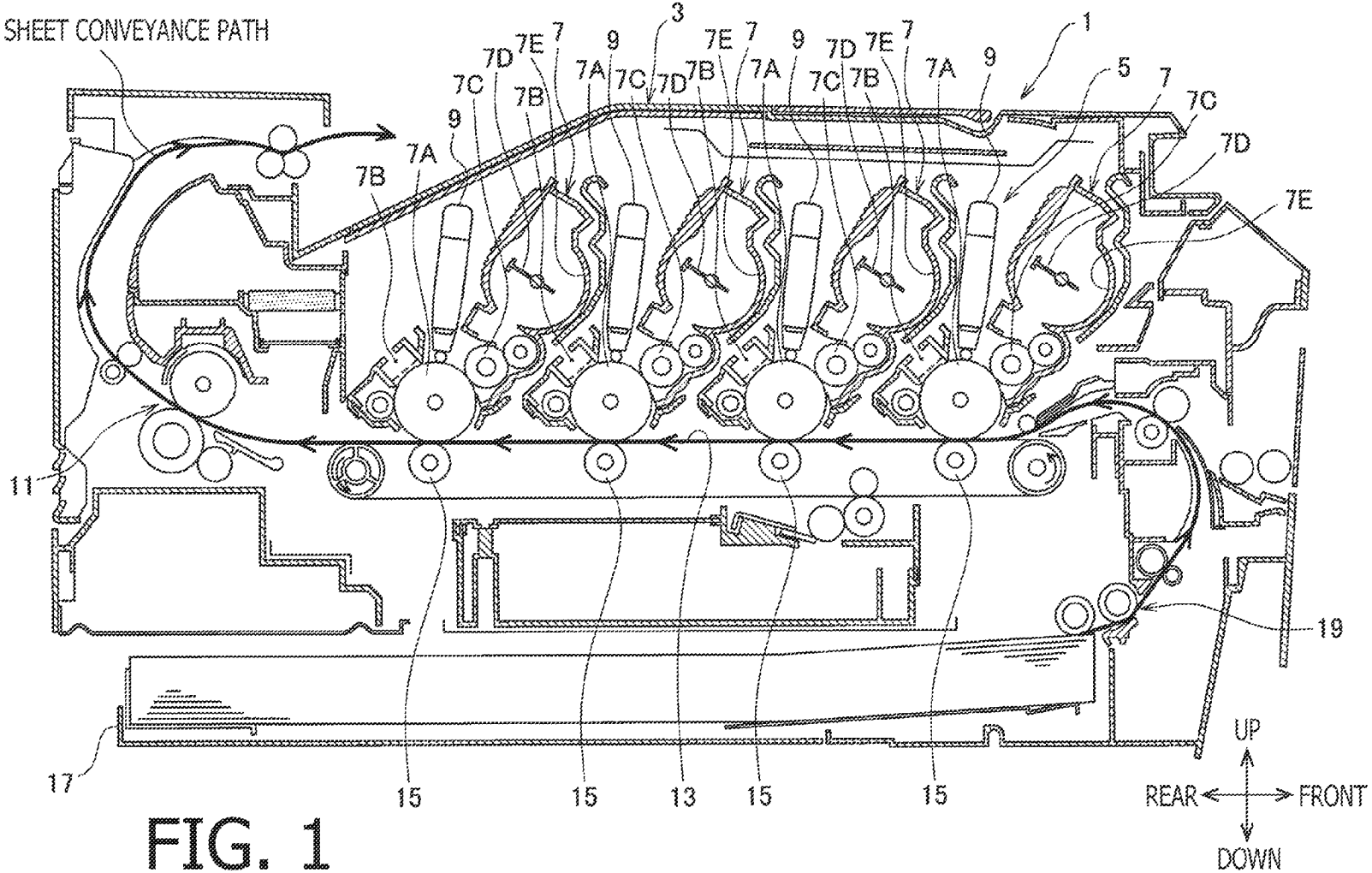
FIG. 1 is a cross-sectional side view schematically showing an internal configuration of an image forming apparatus in an embodiment according to one or more aspects of the present invention.

As shown in FIG. 1, an image forming apparatus 1 has a housing 3, which accommodates an image forming unit 5 configured to form an image on a sheet (such as a recording paper) in an electrophotographic method to transfer a developer image onto the sheet. The image forming unit 5 includes a plurality of process cartridges 7, a plurality of exposure units 9, and a fuser unit 11.

The image forming unit 5 is of a direct tandem type in which the plurality of process cartridges 7 (in the embodiment, four process cartridges 7) are arranged in tandem along a sheet conveyance direction.

The process cartridges 7, except for storing therein respective different colors of development agent, have substantially the same configuration. Specifically, each process cartridge 7 includes a photoconductive drum 7A, a charger 7B, a development roller 7C, and an agitator 7D.

It is noted that, in the following descriptions, an apparatus main body represents a portion such as a main frame (not shown) that supports the housing 3 and the image forming unit 5 and is not broken down by a user. Nevertheless, the apparatus main body may be regarded as being substantially equivalent to the image forming apparatus 1. Hereinafter, the apparatus main body will be referred to as an apparatus main body 1.

The photoconductive drum 7A is configured to hold and carry a developer image. The charger 7B is configured to charge the photoconductive drum 7A. The exposure unit 9 is configured to expose the charged photoconductive drum 7A and form an electrostatic latent image on the photoconductive drum 7A.

The development roller 7C is configured to rotate in response to receipt of a driving force from the apparatus main body 1, and to supply development agent to the photoconductive drum 7A with the electrostatic latent image formed thereon. The agitator 7D is configured to be rotated by a driving force from the apparatus main body 1, and to agitate development agent stored in a container 7E and charge the development agent.

Further, there are transfer portions 15 each disposed to face a corresponding one of the photoconductive drums 7A across a transfer belt 13. Each transfer portion 15 is configured to transfer onto the sheet the developer image carried on a corresponding one of the photoconductive drums 7A. The developer images carried on the photoconductive drums 7A are sequentially transferred onto the sheet being conveyed on the transfer belt 13 in a superimposed manner. Then, the developer images transferred onto the sheet are heated and fixed onto the sheet by a fuser unit 11.

There is a feed tray 17 disposed under the transfer belt 13. The feed tray 17 is configured to receive placement of a stack of sheets. The sheets placed on the feed tray 17 are fed to the image forming unit 5 on a sheet-by-sheet basis by a feeding mechanism 19.

2. Process Cartridges

Figure 2:
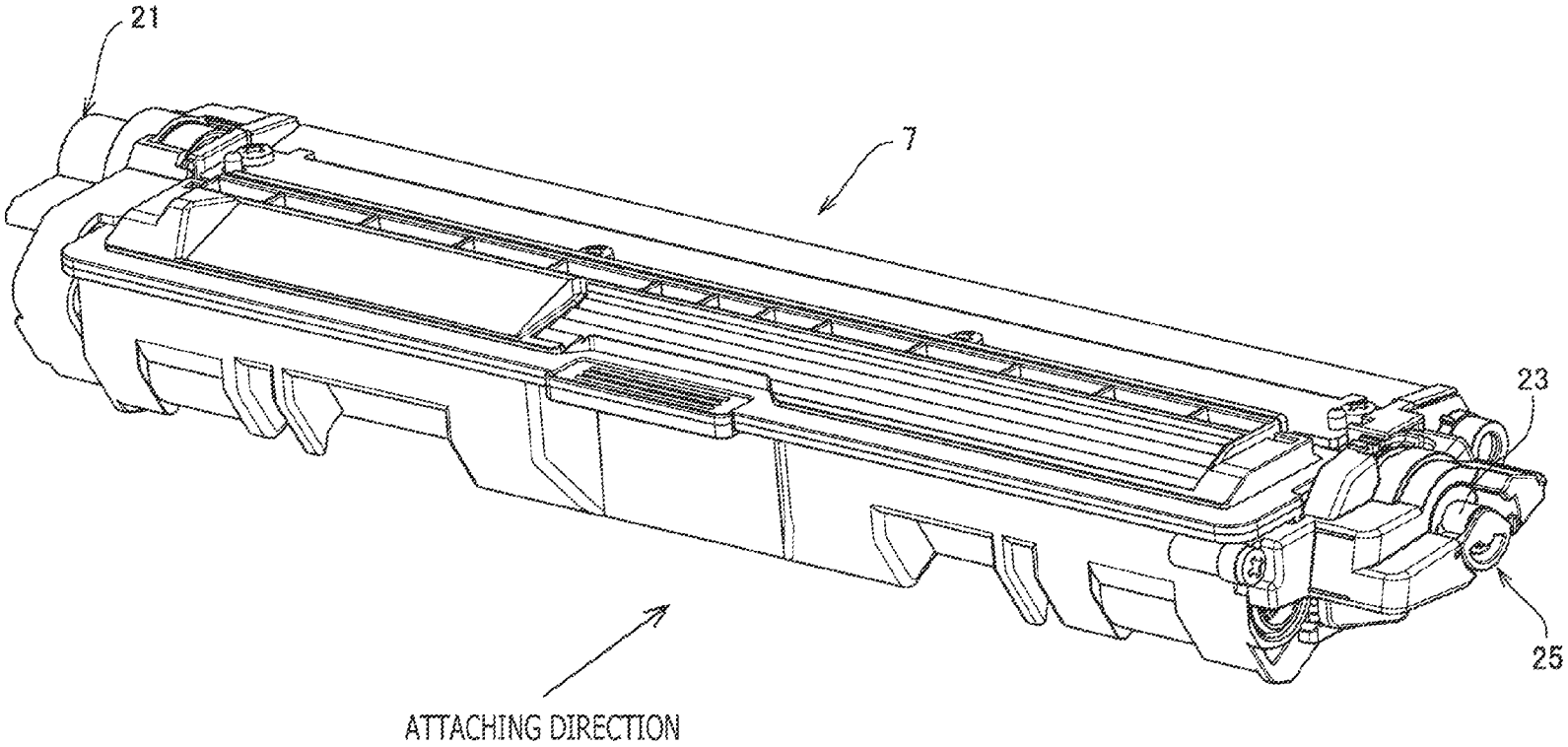
FIG. 2 is a perspective view showing an external configuration of a process cartridge for the image forming apparatus in the embodiment according to one or more aspects of the present invention.

As shown in FIG. 2, each process cartridge 7 is attached to the apparatus main body 1 in such a manner that a longitudinal direction of the process cartridge 7 is coincident to an axial direction of the photoconductive drum 7A. A joint portion 21 is provided at a first end (a left end in FIG. 2) in the longitudinal direction of the process cartridge 7. The joint portion 21 is configured to receive a driving force supplied from the apparatus main body 1. It is noted that, in the embodiment, the axial direction of the photoconductive drum 7A is perpendicular to a moving direction of the transfer belt 13.

The driving force transmitted to the process cartridge 7 via the joint portion 21 is transmitted to movable elements such as the development roller 7C and the agitator 7D in the process cartridge 7, via a gear train not shown).

Figure 3:
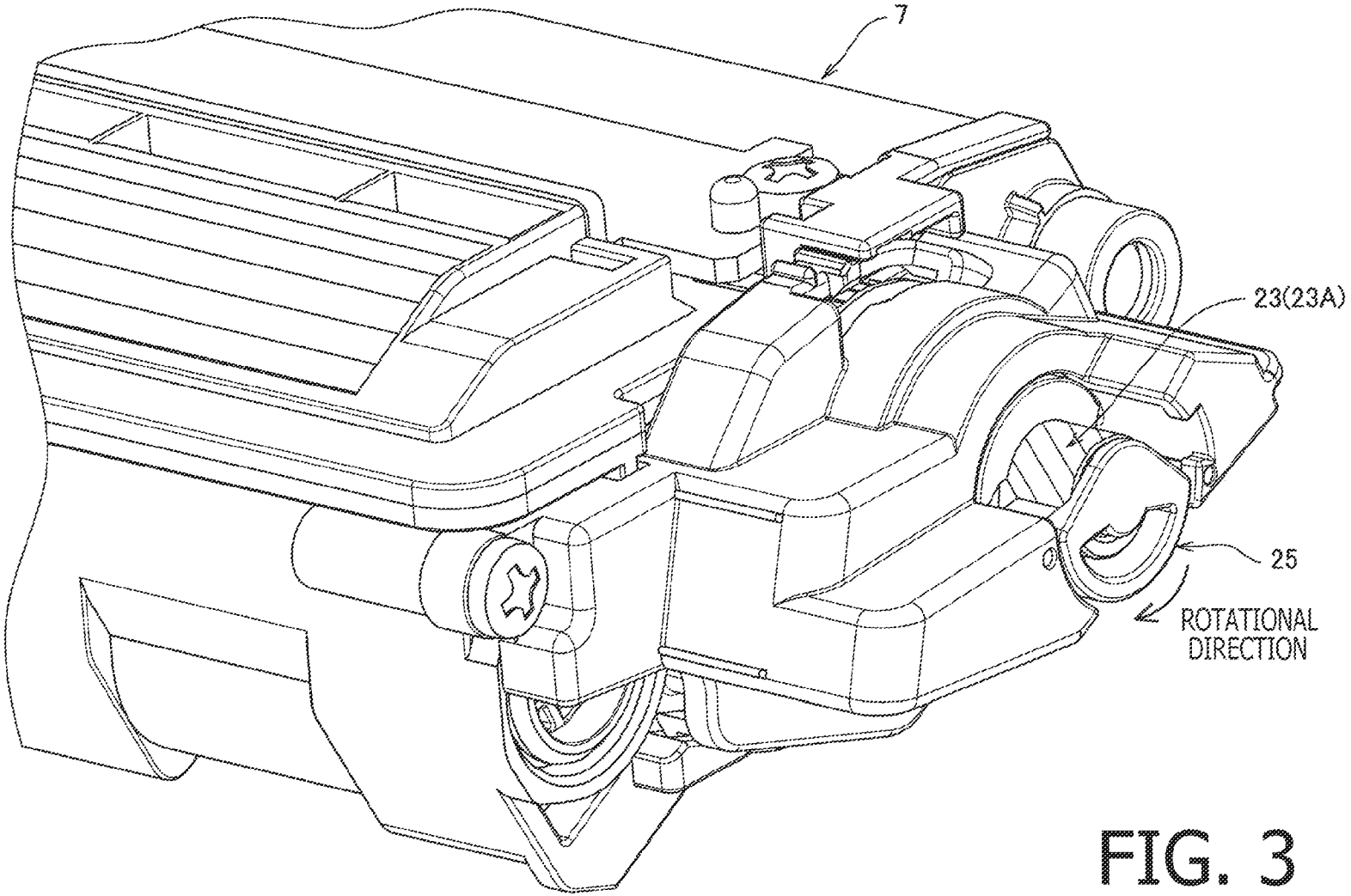
FIG. 3 is an enlarged view showing a side, close to a displacement member, of the process cartridge in the embodiment according to one or more aspects of the present invention.

As shown in FIG. 3, a conductive section 23, which is electrically connected with the development roller 7C, is provided at a second end (opposite to the first end) in the longitudinal direction of the process cartridge 7. Namely, the development roller 7C is one of electrical components that is configured to electrostatically attract (absorb) charged development agent and supply the development agent to the photoconductive drum 7A.

In the embodiment, a voltage is applied to the development roller 7C via the conductive section. The conductive section 23 is formed in a cylindrical shape and configured such that an outer circumferential surface 23A thereof (hatched with diagonal lines in FIG. 3) contacts a below-mentioned power feeder 29A.

Figure 4A:
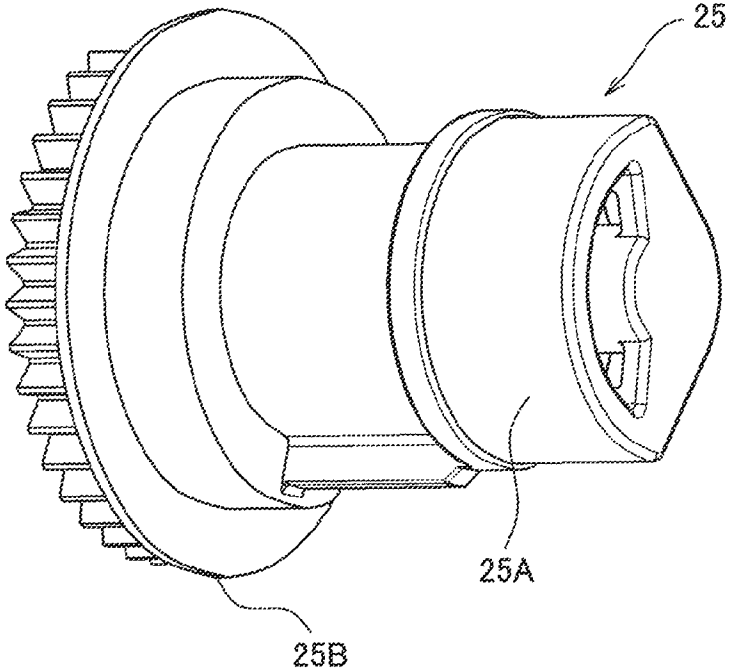
FIGS. 4A and 4B show the displacement member in the embodiment according to one or more aspects of the present invention.

A displacement member 25 is disposed at the second end in the longitudinal direction of the process cartridge 7. The displacement member 25 is configured to move from such a first position (see FIG. 6) as to expose a specific side, close to a below-mentioned movable member 27, of the outer circumferential surface 23A of the conductive section 23, via such a second position (see FIG. 7) as to cover the specific side of the outer circumferential surface 23A, to such a third position (see FIG. 8) as to expose the specific side of the outer circumferential surface 23A. Further, as shown in FIG. 4A, the displacement member 25 includes a cover 25A for covering the outer circumferential surface 23A of the conductive section 23. The cover 25A is movably (rotatably) disposed on an outer side in a radial direction of the conductive section 23.

Specifically, the cover 25A is configured to rotate around a center of curvature of the outer circumferential surface 23A in response to receipt of a rotational force transmitted via a gear 25B. In the embodiment, the cover 25A and the gear 25B are integrally formed as a single-piece resin component.

The gear 25B is configured to engage with a driving gear (not shown) disposed on the second end in the longitudinal direction of the process cartridge 7. The driving gear is disposed at the second end in a longitudinal direction of the agitator 7D, and is configured to rotate integrally with the agitator 7D. Namely, the displacement member 25 is configured to rotate in response to receipt of a driving force transmitted from the apparatus main body 1 via the agitator 7D.

Figure 4B:
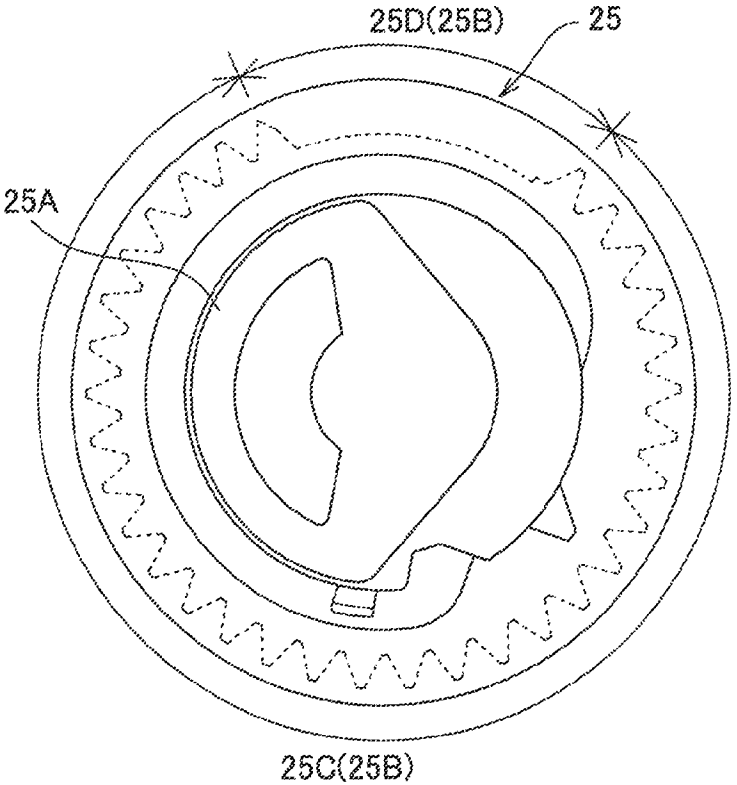

Further, as shown in FIG. 4B, the gear 25B includes a teeth section 25C having teeth (projections) for engaging with the driving gear and a tooth-lacking section 25D having no tooth (no projection). Therefore, when the tooth-lacking section 25D faces the driving gear, the displacement member 25 is not allowed to receive the driving force from the apparatus main body 1.

An unused (new) process cartridge 7 has the displacement member 25 attached to a position thereof where the teeth section 25C is allowed to engage with the driving gear, i.e., a position where the displacement member 25 is allowed to receive the driving force from the apparatus main body 1.

Figure 5:
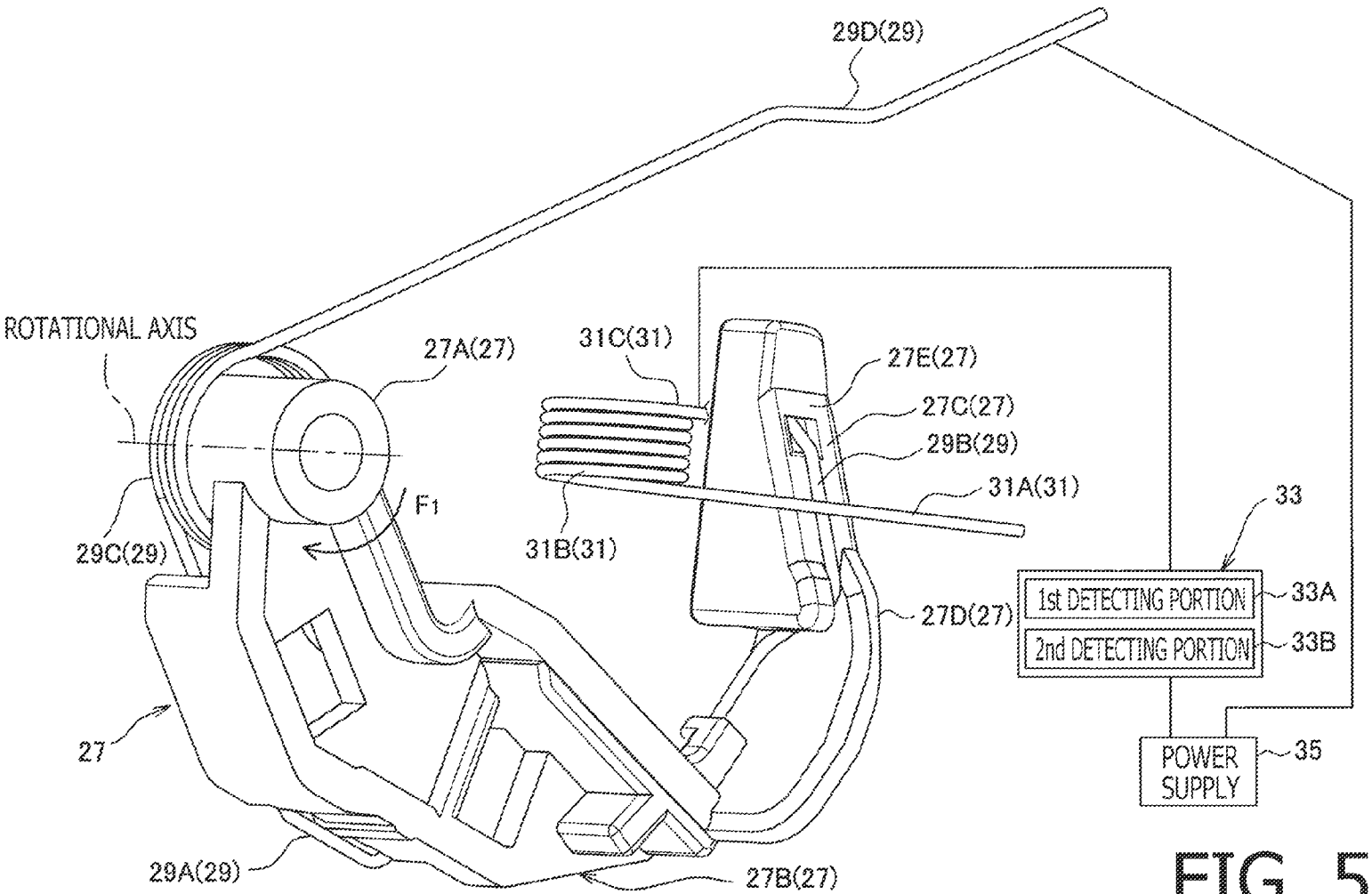
FIG. 5 shows a power feeder, a first electrode, a second electrode, and a wiring configuration thereof in the embodiment according to one or more aspects of the present invention.
Figure 7:
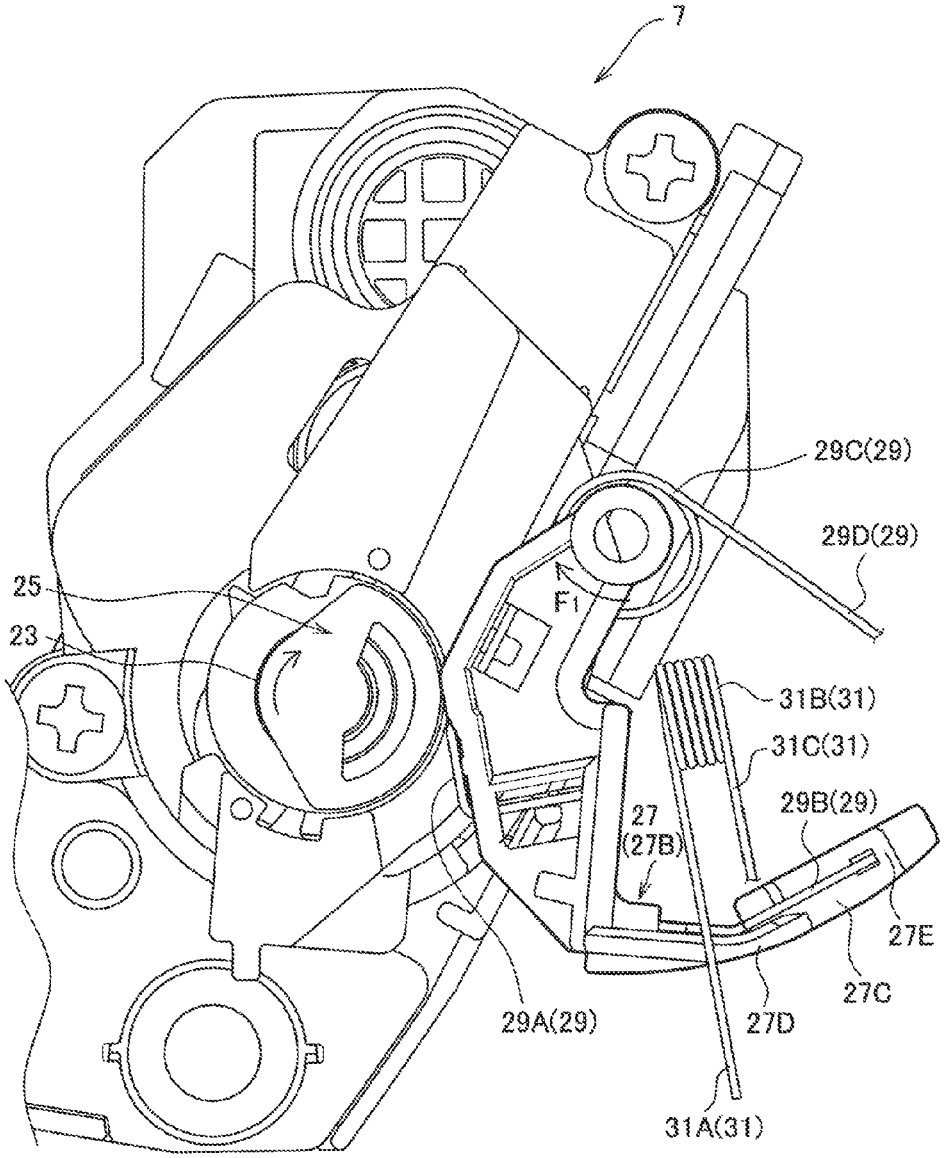
FIG. 7 shows a second state where the displacement member is in such a second position that the conductive section is brought into non-contact with the power feeder, and the first electrode is brought into non-contact with the second electrode in the embodiment according to one or more aspects of the present invention.
Figure 8:
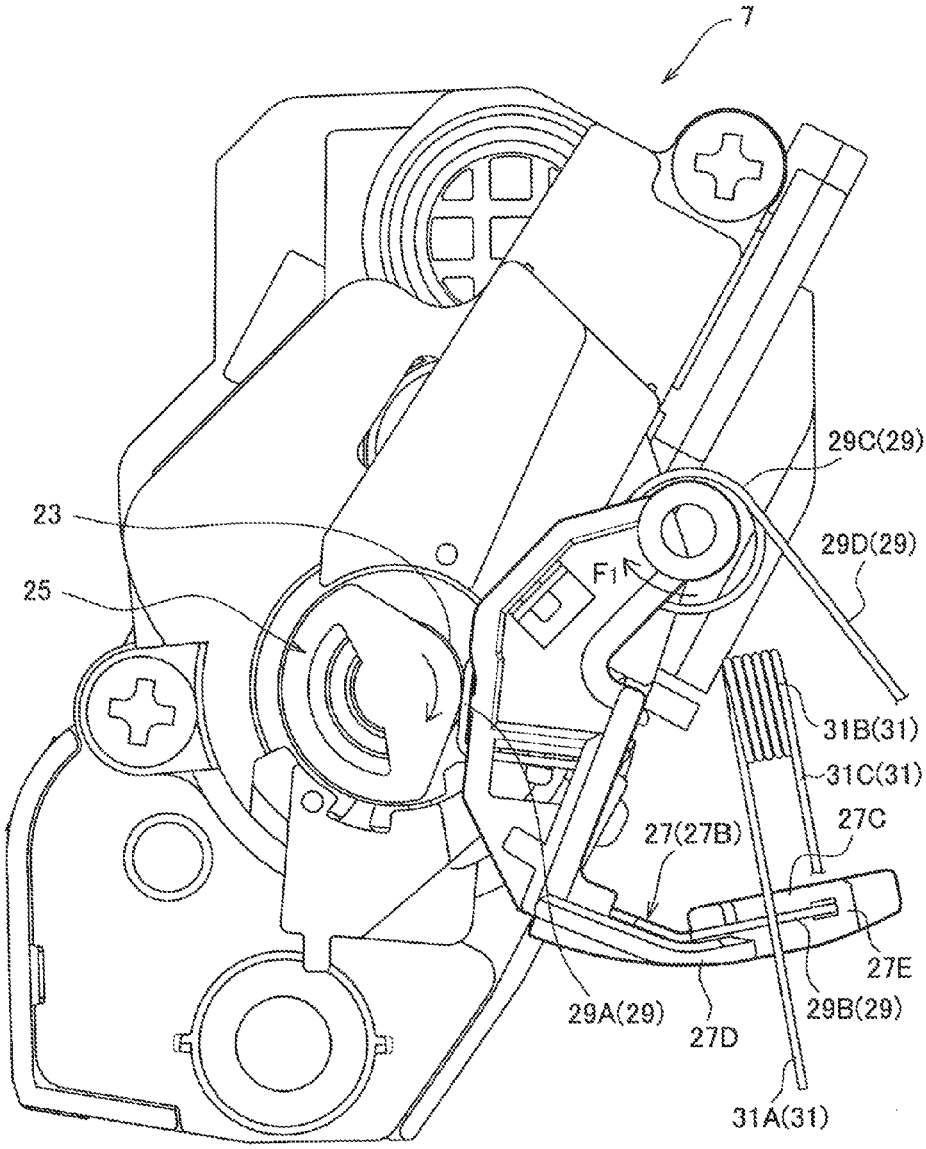
FIG. 8 shows a third state where the displacement member is in such a third position that the conductive section contacts the power feeder, and the first electrode contacts the second electrode in the embodiment according to one or more aspects of the present invention.

3. Power Feeding to Conductive Section and Detection of Information about Process Cartridge 3.1. Configurations of Electrodes and End Terminals A movable member 27 shown in FIG. 5 is movably attached to the apparatus main body 1. In addition, as shown in FIGS. 6-8, the movable member 27 is configured to move responsive to the position (displacement) of the displacement member 25.

Specifically, as shown in FIG. 5, the movable member 27 includes a shaft supporter 27A configured such that a shaft (not shown) provided to the apparatus main body 1 is inserted thereinto, and a lever 27B that extends substantially in a C-shape from the shaft supporter 27A. In the embodiment, the shaft supporter 27A and the lever 27B are integrally formed as a single-piece resin component.

Figure 6:
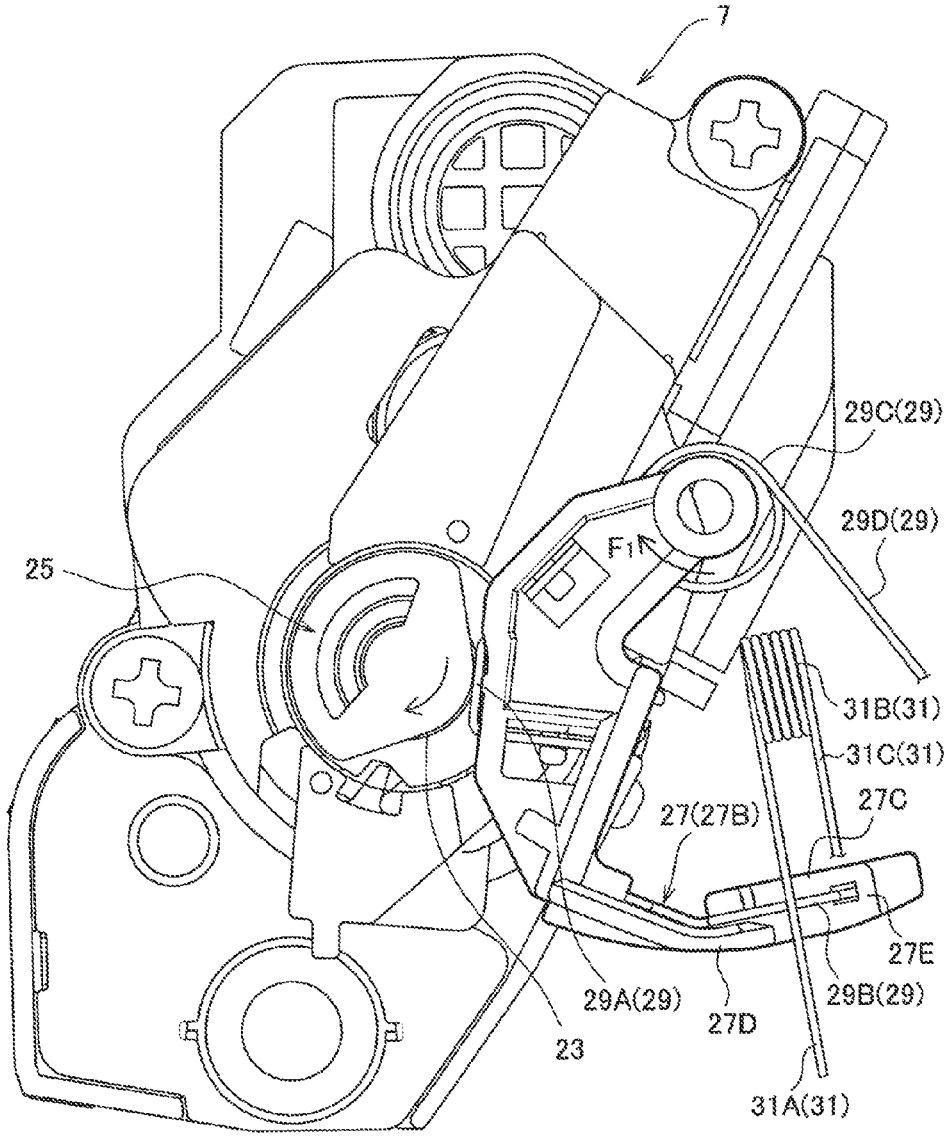
FIG. 6 shows a first state where the displacement member is in such a first position that a conductive section contacts the power feeder, and the first electrode contacts the second electrode in the embodiment according to one or more aspects of the present invention.

As shown in FIG. 6, the lever 27B includes the power feeder 29A configured to contact the conductive section 23 and apply a voltage to the development roller 7C. Additionally, the lever 27B includes a first electrode 29B provided to a position, of the lever 27B, off the power feeder 29A. The first electrode 29B is electrically connected with the power feeder 29A.

Specifically, the power feeder 29A and the first electrode 29B are provided at the apparatus main body 1 via the movable member 27. Further, the power feeder 29A and the first electrode 29B are included in a first terminal member 29 that is a single member. The first terminal member 29 is formed from a metal wire (such as a spring steel) with high elasticity (toughness).

Further, as shown in FIG. 7, the movable member 27 is configured to contact the displacement member 25 and to move in response to a force received via a contact portion of the movable member 27 with the displacement member 25. A first spring 29C is configured to apply, to the movable member 27, an elastic force F1 for pressing the movable member 27 against the displacement member 25.

In the embodiment, the first spring 29C is formed integrally with the first terminal member 29. Specifically, the first spring 29C is a coil-shaped portion into which a part of the metal wire for forming the first terminal member 29 is formed.

When a side, close to the lever 27B, of the conductive section 23 is covered with the displacement member 25 (the cover 25A), the movable member 27 is pressed by the displacement member 25 and swings in such a direction as to become farther away from the conductive section 23.

Meanwhile, as shown in FIGS. 6 and 8, when the displacement member 25 (the cover 25A) is out of such a position (see FIG. 7) where the displacement member 25 (the cover 25A) faces the lever 27B, the movable member 27 swings to a position closer to the conductive section 23, so as to allow the power feeder 29A to contact the conductive section 23.

Figure 9:
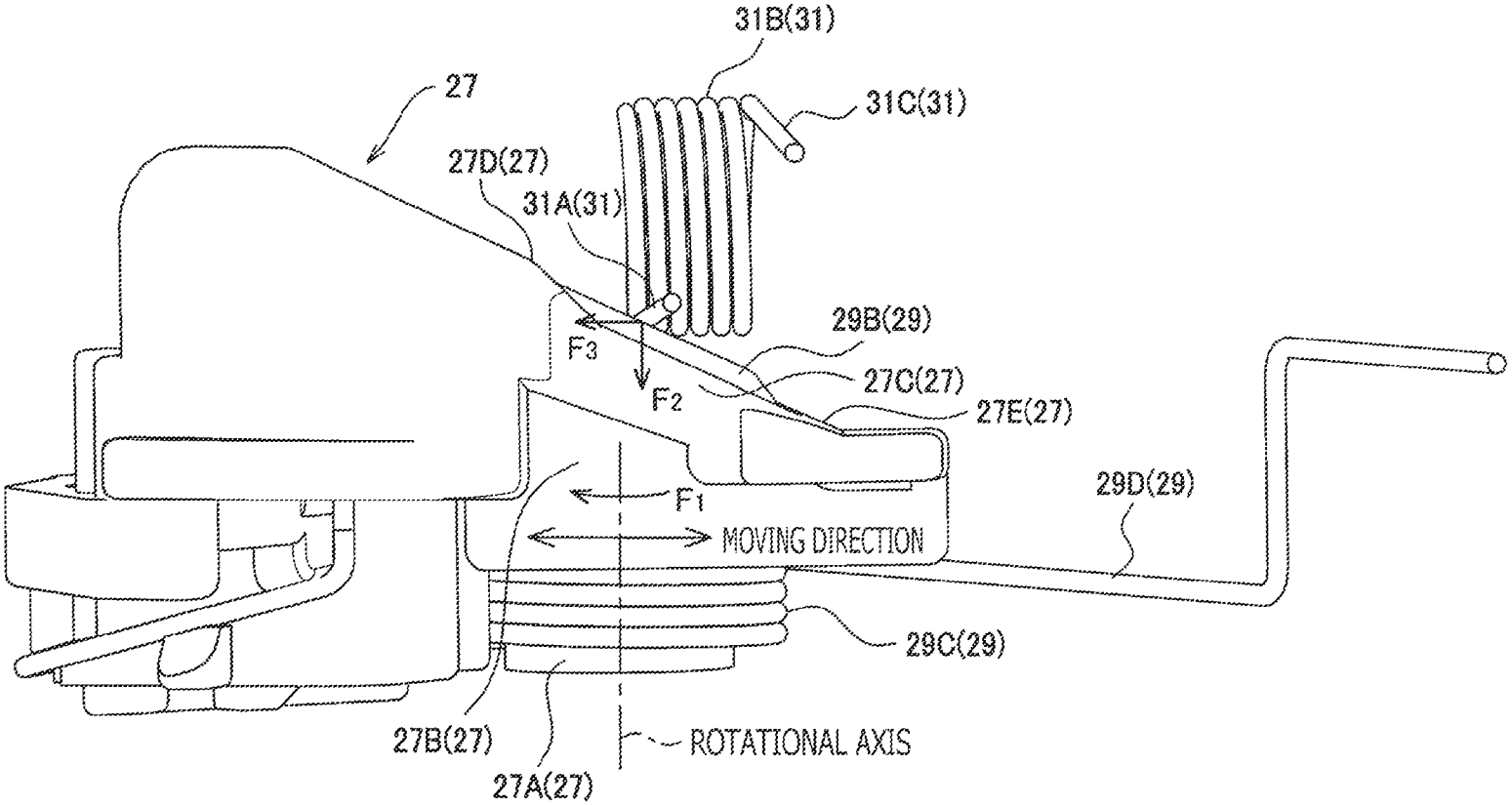
FIG. 9 shows a movable member in a state where a second spring applies, to the second electrode, an elastic force for pressing the second electrode against the first electrode in the embodiment according to one or more aspects of the present invention.

Further, as shown in FIG. 5, the apparatus main body 1 includes a second electrode 31A configured to be in contact with and spaced apart from the first electrode 29B. As shown in FIG. 9, a second spring 31B is configured to apply, to the second electrode 31A, an elastic force F2 for pressing the second electrode 31A against the first electrode 29B.

The second electrode 31A and the second spring 31B are included in a second terminal member 31 formed from a metal wire (such as a spring steel) with high elasticity (toughness). The second spring 31B is a coil-shaped portion into which a part of the second terminal member is formed.

Further, at least a portion of the first electrode 29B that contacts the second electrode 31A is inclined with respect to a moving direction of the movable member 27. Specifically, the first electrode 29B, at a contact portion thereof with the second electrode 31A, is inclined in such a direction as to generate a force F3 (see FIG. 9) acting in a direction toward the displacement member 25, with respect to the moving direction of the movable member 27. It is noted that the force F3 is a force component, of the elastic force F2, parallel to the moving direction of the movable member 27.

Further, the lever 27B includes a first portion 27C at which the first electrode 29B is disposed, and second portions 27D and 27E that are disposed respectively on two sides of the lever 27B opposite to each other across the first portion 27C in the moving direction of the movable member 27. The first portion 27C and the second portions 27D and 27E are inclined with respect to the moving direction of the movable member 27 in the same manner as the first electrode 29B.

The second portions 27D and 27E are disposed in respective positions away from the first portion 27C in the moving direction of the movable member 27. As shown in FIG. 5, at the second portions 27D and 27E, the first terminal member 29 is not allowed to contact the electrode 31A.

Therefore, as shown in FIGS. 6 and 8, when the first portion 27C faces the second electrode 31A, the first electrode 29B contacts the second electrode 31A. Further, as shown in FIG. 7, when the second portion 27D faces the second electrode 31A, the first electrode 29B is spaced apart from the second electrode 31A.

Figure 10A:
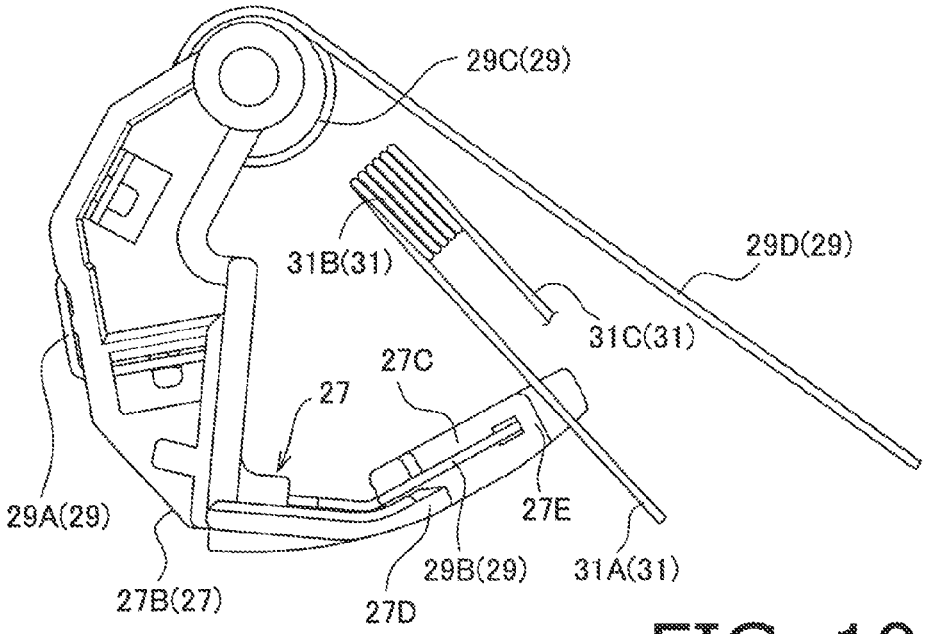
FIG. 10A shows the movable member in a state where the first electrode is spaced apart from the second electrode when the process cartridge is detached in the embodiment according tip one or more aspects of the present invention.

Further, when the process cartridge 7 is detached from the apparatus main body 1, a force against the elastic force F1 of the first spring 29C disappears. Therefore, the movable member 27 moves in a direction of the elastic force F1. Accordingly, as shown in FIG. 10A, the movable member 27 moves to a position where the second portion 27E faces the second electrode 31A, and the first electrode 29B is spaced apart from the second electrode 31A.

3.2. Detector for Detecting Information about Process Cartridge

As shown in FIG. 5, a detector 33 is configured to detect information about the process cartridge 7 based on a conduction state between the first electrode 29B and the second electrode 31A. Specifically, a predetermined voltage is supplied, from a power supply 35, to a first voltage-applied portion 29D, on a side opposite to the power feeder 29A, of the first terminal member 29, and to a second voltage-applied portion 31C, on a side opposite to the second electrode 31A, of the second terminal member 31.

The detector 33 includes a first detecting portion 33A and a second detecting portion 33B. The first detecting portion 33A is configured to detect whether the process cartridge 7 attached to the apparatus main body 1 is new. The second detecting portion 33B is configured to detect whether there is a process cartridge 7 attached to the apparatus main body 1.

In the embodiment, the detector 33 includes a microcomputer having a CPU, a ROM, and a RAM. Namely, the first detecting portion 33A and the second detecting portion 33B are achieved by execution of programs previously stored in a non-volatile memory such as the ROM.

<Operation of Detecting New Cartridge>

In the embodiment, the first detecting portion 33A is configured to detect a high-level signal (hereinafter referred to as a signal) when the first electrode 29B contacts the second electrode 31A, and to detect a low-level signal (hereinafter referred to as a Lo signal) when the first electrode 29B is spaced apart from the second electrode 31A.

The displacement member 25 of an unused (new) process cartridge 7 is in an engaged position (including the first position) where the teeth section 25C engages with the driving gear. When the displacement member 25 is in the engaged position (including the first position), as shown in FIG. 6, the conductive section 23 contacts the power feeder 29A, and the first electrode 29B contacts the second electrode 31A. Hereinafter, a state shown in FIG. 6 will be referred to as a first state.

In the first state, when a warm-up operation is started, or an image forming instruction is issued, firstly, the agitator 7D is supplied with the driving force and begins to rotate. It is noted that the warm-up operation is an operation mode to be executed when it is impossible to start image formation promptly, e.g., immediately after the image forming apparatus 1 is turned on.

Thereby, the displacement member 25 rotates to an un-engaged position where the tooth-lacking section 25D faces the driving gear. Then, when the displacement member 25 is in the un-engaged position, transmission of the driving force from the driving gear to the displacement member 25 is interrupted.

Therefore, since then, even when the agitator 7D rotates, the displacement member 25 stays in the un-engaged position without rotating. Namely, the displacement member 25 only once rotates from the engaged position to the un-engaged position. Hereinafter, the rotation from the engaged position to the un-engaged position will be referred to as initial displacement.

When the displacement member 25 is in the un-engaged position (including the third position), as shown in FIG. 8, the conductive section 23 contacts the power feeder 29A, and the first electrode 29B contacts the second electrode 31A. Hereinafter, a state shown in FIG. 8 will be referred to as a third state.

Further, in a middle of the initial displacement, the displacement member 25 is in the second position as shown in FIG. 7 where the conductive section 23 is brought into non-contact with the power feeder 29A, and the second electrode 31A is placed at the second portion 27D and brought into non-contact with the first electrode 29B. Hereinafter, a state shown in FIG. 7 will be referred to as a second state.

Figure 10B:
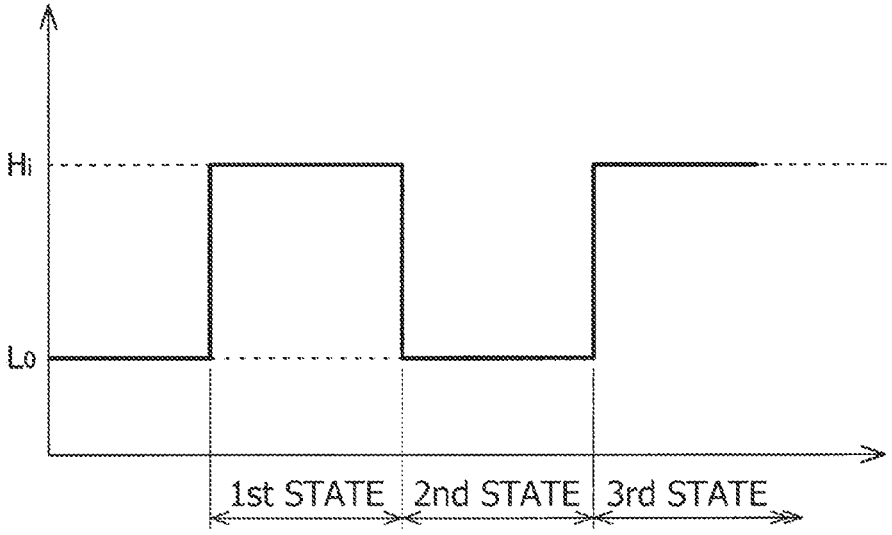
FIG. 10B shows a new cartridge signal pattern in the embodiment according to one or more aspects of the present invention.

Namely, in the initial displacement of the displacement member 25, the state (which defines positional relationships between elements such as the conductive section 23, the power feeder 29A, the first electrode 29B, and the second electrode 31A) varies in an order of the first state (FIG. 6)→the second state (FIG. 7)→the third state (FIG. 8). Accordingly, as shown in FIG. 10B, the detector 33 detects a signal pattern (hereinafter referred to as a new cartridge signal pattern) varying in an order of the Hi signal→the Lo signal→the Hi signal.

When detecting the new cartridge signal pattern within a predetermined time period, the first detecting portion 33A determines that an unused (new) process cartridge 7 is attached to the apparatus main body 1, and initializes one or more parameters representing a usage status of the process cartridge 7. It is noted that the one or more parameters representing the usage status of the process cartridge 7 may include a parameter representing a remaining amount of development agent stored in the container 7E.

<Detection of Process Cartridge>

Since the displacement member 25 is in the un-engaged position, each of elements such as the movable member 27, the first terminal member 29, and the second terminal member 31 remains in the third state as long as the process cartridge 7 is attached to the apparatus main body 1.

When the process cartridge 7 is removed from the apparatus main body 1, the movable member 27, as shown in FIG. 10A, moves to a position where the second portion 27E faces the second electrode 31A, and the first electrode 29B is spaced apart from the second electrode 31A.

Accordingly, when the detector 33 continuously receives the Hi signal for more than a predetermined time period, the second detecting portion 33B determines that the process cartridge 7 is attached to the apparatus main body 1. Meanwhile, when the detector 33 continuously receives the Lo signal for more than a predetermined time period, the second detecting portion 33B determines that the process cartridge 7 is not attached to the apparatus main body 1.

Namely, when detecting the new cartridge signal pattern since the determination that the process cartridge 7 is not attached to the apparatus main body 1, the detector 33 determines that an unused (new) process cartridge 7 is attached to the apparatus main body 1. Meanwhile, when continuously receiving the Hi signal for more than a predetermined time period since the determination that the process cartridge 7 is not attached to the apparatus main body 1, the detector 33 determines that a used process cartridge 7 is attached to the apparatus main body 1.

4. Features of Image Forming Apparatus

In the embodiment, once the displacement member 25 disposed at the process cartridge 7 moves from an unused-cartridge position (i.e., the first position shown in FIG. 6) to a used-cartridge position (i.e., the third position shown in FIG. 8) in response to receipt of the driving force from the apparatus main body 1, the displacement member 25 is not allowed to receive the driving force from the apparatus main body 1. In other words, once the displacement member 25 is placed in the used-cartridge position, the displacement member 25 stays in the used-cartridge position without being able to move.

Therefore, in a process cartridge 7 that has never received the driving force from the apparatus main body 1, that is, a new (unused) process cartridge 7, the displacement member 25 is in the unused-cartridge position. Meanwhile, when the process cartridge 7 is attached to the apparatus main body 1, and the development roller 7C and the agitator 7D are driven (i.e., once the process cartridge 7 is used), the displacement member 25 moves to and stays in the used-cartridge position.

Accordingly, by detecting contact/non-contact between the first electrode 29B and the second electrode 31A, i.e., the conduction state between the first electrode 29B and the second electrode 31A, it is possible to detect information about the process cartridge 7 without using any optical sensor.

Further, in the embodiment, the first terminal member 29, which is a single member, includes the power feeder 29A, the first electrode 29B, and the first spring 29C configured to press the movable member 27 against the displacement member 25.

Thereby, in the embodiment, since the first terminal member 29 includes the first spring 29C, it is not required to provide a separate spring for pressing the movable member 27 against the displacement member 25. Thus, it is possible to prevent increase in the number of components.

Further, in the embodiment, the image forming apparatus 1 includes the second spring 31B configured to press the second electrode 31A against the first electrode 29B. In addition, at least a portion of the first electrode 29B that contacts the second electrode 31A is inclined with respect to the moving direction of the movable member 27.

Thereby, in the embodiment, at the contact portion between the second electrode 31A and the first electrode 29B, caused is a force (hereinafter referred to as a parallel component force) acting in the direction parallel to the moving direction of the movable member 27. Thus, it results in a small normal force generated at the contact portion between the second electrode 31A and the first electrode 29B. Further, it leads to a small frictional force generated at the contact portion between the second electrode 31A and the first electrode 29B.

Accordingly, it is possible to reduce a resistive force generated at the contact portion when the process cartridge 7 is detached from the apparatus main body 1. Thus, it is possible to certainly separate the second electrode 31A from the first electrode 29B when the process cartridge 7 is detached from the apparatus main body 1.

Further, by appropriately selecting a direction in which the first electrode 29B is inclined (with respect to the moving direction of the movable member 27), it is possible to use the parallel component force as a force for pressing the movable member 27 against the displacement member 25. Accordingly, it is possible to move the movable member 27 while certainly making the movable member 27 follow the movement of the displacement member 25.

Hereinabove, the embodiment according to aspects of the present invention has been described. The present invention can be practiced by employing conventional materials, methodology and equipment. Accordingly, the details of such materials, equipment and methodology are not set forth herein in detail in the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations about the same configurations as exemplified in the aforementioned embodiment will be omitted.

[Modifications]

In the aforementioned embodiment, the displacement member 25 includes the teeth section 25C and the tooth-lacking section 25D and is configured to rotate. However, the displacement member 25 may include the teeth section 25C and the tooth-lacking section 25D and may be configured to be translated.

In the aforementioned embodiment, the displacement member 25 is configured to receive the driving force transmitted from the apparatus main body 1 via the agitator 7D. However, the displacement member 25 may be configured to receive the driving force from the development roller 7C. Alternatively, the displacement member 25 may be configured to receive the driving force directly from the apparatus main body 1.

In the aforementioned embodiment, the development roller 7C is exemplified as an electrical component and a movable element. In a modification according to aspects of the present invention, the charger 7B may be employed as an electrical component. Further, the agitator 7D may be included in movable elements.

In the aforementioned embodiment, the photoconductive drum 7A is configured to remain in the apparatus main body 1 when the process cartridge 7 is detached from the apparatus main body 1. However, the photoconductive drum 7A may be provided to the process cartridge 7.

In the aforementioned embodiment, aspects of the present invention are applied to the image forming apparatus 1 employing a direct transfer method. However, aspects of the present invention may be applied to an image forming apparatus employing an intermediate transfer method.

In the aforementioned embodiment, the exposure unit 9, which is provided for each photoconductive drum 7A, includes a plurality of LEDs arranged along the axial direction of the photoconductive drum 7A. However, a scanning-type exposure unit may be employed, which is configured to scan laser light in the axial direction of the photoconductive drum 7A.

In the aforementioned embodiment, the second portions 27D and 27E are provided on the two sides of the lever 27B across the first portion 27C, respectively. However, a second portion may be provided on only one side of the lever 27B with respect to the first portion 27C.

In the aforementioned embodiment, the detector 33 includes the microcomputer, and the first detecting portion 33A and the second detecting portion 33B are achieved by software. However, the first detecting portion 33A and the second detecting portion 33B may be achieved by hardware.

What is claimed is:

1. An image forming apparatus comprising:

an apparatus main body;

a cartridge configured to be detachably attached to the apparatus main body, the cartridge comprising:

an electrical component; and a conductive section electrically connected with the electrical component;

a power feeder disposed at the apparatus main body and configured to contact the conductive section and apply a voltage to the electrical component;

a first electrode disposed at the apparatus main body and electrically connected with the power feeder;

a second electrode disposed at the apparatus main body and configured to be in contact with and spaced apart from the first electrode;

a displacement member disposed at the cartridge and configured to move from a position where the displacement member is allowed to receive a driving force from the apparatus main body to a different position where the displacement member is not allowed to receive the driving force from the apparatus main body;

a movable member disposed at the apparatus main body, the movable member being configured to move in response to movement of the displacement member, so as to move the first electrode between a contact position where the first electrode contacts the second electrode and a non-contact position where the first electrode is spaced apart from the second electrode; and a detector configured to detect information about the cartridge attached to the apparatus main body based on a conduction state between the first electrode and the second electrode, wherein the movable member is configured to contact the displacement member at a contact portion thereof and to move in response to receipt of a force via the contact portion of the movable member with the displacement member, and wherein the apparatus main body comprises a terminal member comprising:

the power feeder;

the first electrode; and a terminal-side spring configured to press the movable member against the displacement member.

2. The image forming apparatus according to claim 1, wherein the movable member comprises:

a first portion at which the first electrode is disposed, the first portion being configured to allow, when facing the second electrode, the first electrode to contact the second electrode; and a second portion disposed in a position away from the first portion in a moving direction of the movable member, the second portion being configured to, when facing the second electrode, allow the first electrode to be spaced apart from the second electrode.

3. The image forming apparatus according to claim 2, wherein the second portion is disposed on each of two sides of the movable member opposite to each other across the first portion in the moving direction of the movable member.

4. The image forming apparatus according to claim 1, further comprising an electrode pressing spring configured to press the second electrode against the first electrode, wherein at least a portion of the first electrode that contacts the second electrode is inclined with respect to a moving direction of the movable member.

5. The image forming apparatus according to claim 1, wherein the electrical component is for image formation.

6. The image forming apparatus according to claim 5, wherein the electrical component is a development roller configured to supply development agent to a photoconductive body with an electrostatic latent image formed thereon.

7. The image forming apparatus according to claim 1, wherein the detector comprises a cartridge state detecting portion configured to detect whether the cartridge attached to the apparatus main body is new.

8. The image forming apparatus according to claim 1, wherein the detector comprises a cartridge existence detecting portion configured to detect whether there is a cartridge attached to the apparatus main body.

9. The image forming apparatus according to claim 1, wherein the displacement member is further configured to move, from a first position where the displacement member is allowed to receive the driving force from the apparatus main body, the conductive section contacts the power feeder, and the first electrode is in the contact position to contact the second electrode, via a second position where the conductive section is brought into non-contact with the power feeder, and the first electrode is moved by the movable member to the non-contact position to be spaced apart from the second electrode, to a third position where the displacement member is not allowed to receive the driving force from the apparatus main body, the conductive section contacts the power feeder, and the first electrode is moved by the movable member to the contact position to contact the second electrode, and wherein the detector is further configured to:

detect a change in the conduction state between the first electrode and the second electrode, the conduction state varying depending on a contact state between the first electrode and the second electrode, the contact state varying in response to the movement of the displacement member; and acquire the information about the cartridge based on the detected change in the conduction state between the first electrode and the second electrode.

10. An image forming apparatus comprising:

an apparatus main body;

a cartridge configured to be detachably attached to the apparatus main body, the cartridge comprising:

an electrical component; and a conductive section electrically connected with the electrical component;

a power feeder disposed at the apparatus main body and configured to contact the conductive section and apply a voltage to the electrical component;

a first electrode disposed at the apparatus main body and electrically connected with the power feeder;

a second electrode disposed at the apparatus main body and configured to be in contact with and spaced apart from the first electrode;

a displacement member disposed at the cartridge and configured to move from a position where the displacement member is allowed to receive a driving force from the apparatus main body to a different position where the displacement member is not allowed to receive the driving force from the apparatus main body;

a movable member disposed at the apparatus main body, the movable member being configured to move in response to movement of the displacement member, so as to move the first electrode between a contact position where the first electrode contacts the second electrode and a non-contact position where the first electrode is spaced apart from the second electrode;

a detector configured to detect information about the cartridge attached to the apparatus main body based on a conduction state between the first electrode and the second electrode; and an electrode pressing spring configured to press the second electrode against the first electrode, wherein at least a portion of the first electrode that contacts the second electrode is inclined with respect to a moving direction of the movable member.

11. The image forming apparatus according to claim 10, wherein the movable member comprises:

a first portion at which the first electrode is disposed, the first portion being configured to allow, when facing the second electrode, the first electrode to contact the second electrode; and a second portion disposed in a position away from the first portion in a moving direction of the movable member, the second portion being configured to, when facing the second electrode, allow the first electrode to be spaced apart from the second electrode.

12. The image forming apparatus according to claim 11, wherein the second portion is disposed on each of two sides of the movable member opposite to each other across the first portion in the moving direction of the movable member.

13. The image forming apparatus according to claim 10, wherein the electrical component is for image formation.

14. The image forming apparatus according to claim 13, wherein the electrical component is a development roller configured to supply development agent to a photoconductive body with an electrostatic latent image formed thereon.

15. The image forming apparatus according to claim 10, wherein the detector comprises a cartridge state detecting portion configured to detect whether the cartridge attached to the apparatus main body is new.

16. The image forming apparatus according to claim 10, wherein the detector comprises a cartridge existence detecting portion configured to detect whether there is a cartridge attached to the apparatus main body.

17. The image forming apparatus according to claim 10, wherein the displacement member is further configured to move, from a first position where the displacement member is allowed to receive the driving force from the apparatus main body, the conductive section contacts the power feeder, and the first electrode is in the contact position to contact the second electrode, via a second position where the conductive section is brought into non-contact with the power feeder, and the first electrode is moved by the movable member to the non-contact position to be spaced apart from the second electrode, to a third position where the displacement member is not allowed to receive the driving force from the apparatus main body, the conductive section contacts the power feeder, and the first electrode is moved by the movable member to the contact position to contact the second electrode, and wherein the detector is further configured to:

detect a change in the conduction state between the first electrode and the second electrode, the conduction state varying depending on a contact state between the first electrode and the second electrode, the contact state varying in response to the movement of the displacement member; and acquire the information about the cartridge based on the detected change in the conduction state between the first electrode and the second electrode.

18. An image forming apparatus comprising:

an apparatus main body;

a cartridge configured to be detachably attached to the apparatus main body, the cartridge comprising:

an electrical component; and a conductive section electrically connected with the electrical component;

a power feeder disposed at the apparatus main body and configured to contact the conductive section and apply a voltage to the electrical component;

a first electrode disposed at the apparatus main body and electrically connected with the power feeder;

a second electrode disposed at the apparatus main body and configured to be in contact with and spaced apart from the first electrode;

a displacement member disposed at the cartridge and configured to move from a position where the displacement member is allowed to receive a driving force from the apparatus main body to a different position where the displacement member is not allowed to receive the driving force from the apparatus main body;

a movable member disposed at the apparatus main body, the movable member being configured to move in response to movement of the displacement member, so as to move the first electrode between a contact position where the first electrode contacts the second electrode and a non-contact position where the first electrode is spaced apart from the second electrode; and a detector configured to detect information about the cartridge attached to the apparatus main body based on a conduction state between the first electrode and the second electrode, wherein the displacement member is further configured to move, from a first position where the displacement member is allowed to receive the driving force from the apparatus main body, the conductive section contacts the power feeder, and the first electrode is in the contact position to contact the second electrode, via a second position where the conductive section is brought into non-contact with the power feeder, and the first electrode is moved by the movable member to the non-contact position to be spaced apart from the second electrode, to a third position where the displacement member is not allowed to receive the driving force from the apparatus main body, the conductive section contacts the power feeder, and the first electrode is moved by the movable member to the contact position to contact the second electrode, and wherein the detector is further configured to:

detect a change in the conduction state between the first electrode and the second electrode, the conduction state varying depending on a contact state between the first electrode and the second electrode, the contact state varying in response to the movement of the displacement member; and acquire the information about the cartridge based on the detected change in the conduction state between the first electrode and the second electrode.

* * * * *